US005100139A

United States Patent [19]

Di Bella

[11] Patent Number: 5,100,139

[45] Date of Patent: Mar. 31, 1992

[54] CARD CHANCE GAME APPARATUS AND METHOD OF PLAY

[75] Inventor: Antonio Di Bella, Catania, Italy

[73] Assignee: Chetjack Limited, England

[21] Appl. No.: 621,857

[22] Filed: Dec. 4, 1990

[51] Int. Cl.[5] ..... A63F 3/06

[52] U.S. Cl. ..... 273/138 R; 273/139; 273/269; 283/903

[58] Field of Search ..... 273/138 R, 139, 269, 273/303-306; 283/903, 901

[56] References Cited

U.S. PATENT DOCUMENTS

| | | | |
|---|---|---|---|
| De. 57,994 | 5/1921 | Samuel | 273/306 |
| 4,021,937 | 5/1977 | Kravitz | 273/269 |
| 4,655,461 | 4/1987 | Capri et al. | 273/249 |

FOREIGN PATENT DOCUMENTS

| | | | |
|---|---|---|---|
| 1172231 | 11/1969 | United Kingdom | 273/269 |

OTHER PUBLICATIONS

Regal Bingo advertizement 10/15/74 Class 273, Subclass 269.

*Primary Examiner*—Benjamin Layno
*Attorney, Agent, or Firm*—Hedman, Gibson & Costigan

[57] ABSTRACT

A card change game which includes an ordinary deck of fifty-two playings card, a display board divided into a plurality of squares and a plurality of lottery tickets. The squares on the display board are each uniquely identified by a different number from one to forty. Each square is adapted to display one playing card. Each lottery ticket bears five numbers corresponding to five numbers on the display board. All fifty two cards a represented on a grid of squares arranged in matrix form on each lottery ticket wherein each square represents a specific playing card. To play the card chance game, lottery tickets are issued to the players. Then the cards are shuffled and are randomly dealt face up on the display board, one card on each square, such that each displayed card becomes temporarily associated with a unique number identifying the square the card is displayed on. Players then check which five cards are associated with the five numbers on their lottery tickets. The five associated cards are marked off on the matrix in order to determine whether the five cards relate to a score in poker.

10 Claims, 6 Drawing Sheets

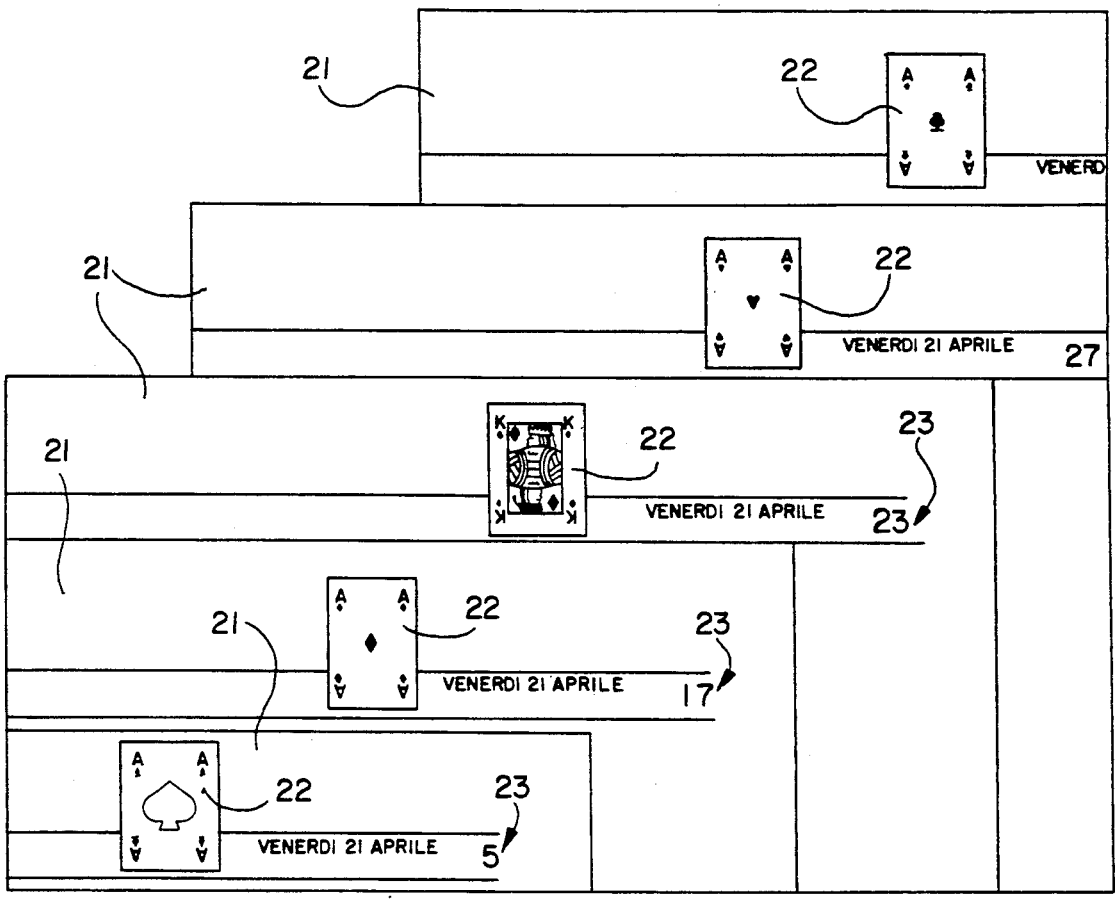
FIG. 10
FIG. 11
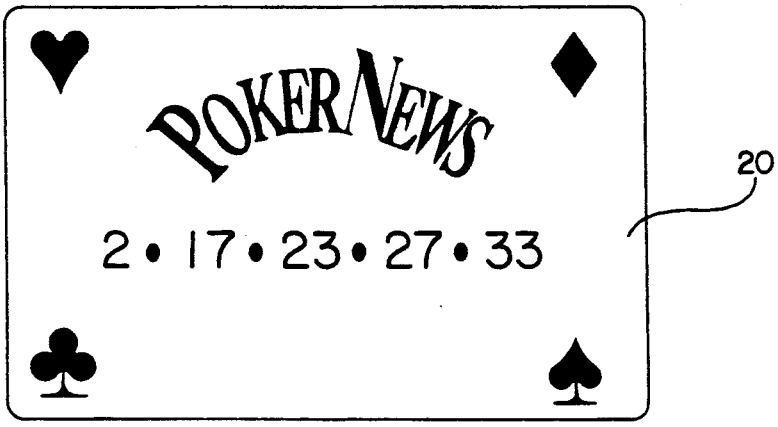

CARD CHANCE GAME APPARATUS AND METHOD OF PLAY

BACKGROUND OF THE INVENTION

This invention relates to a card chance game.

Games of cards have in common the fact that they allow for the simultaneous participation in them of a generally limited number of players. This constitutes a limitation to wider spreading of these games, which on a collective level, are usually replaced by other games basically related to the essential rules of lottery, tombola, or bingo games. On the other hand, such group games miss an interesting facet, which typifies many card games and consists of the faculty afforded to the player of betting on his/her own hand during the game, with consequent increased participant's level of risk and "suspense".

SUMMARY OF THE INVENTION

It is an object of this invention to provide a novel game of cards which can accept the simultaneous participation of a very large number of players.

A further object of the invention is to provide a game of cards which is also attractive for players normally unattracted by participation in the risk which is typical of group games.

Still another object of the invention is to provide a game having a pattern of participation which can be readily grasped.

These and other objects are achieved, according to the invention, by a card chance game comprising the steps of, providing a deck of playing cards, temporarily associating each card in the deck with a symbol selected irrespectively of the worth of said card, providing a plurality of tickets, each bearing a discrete series of said symbols corresponding to said cards, and allotting, according to the rules of a known game of cards, a score for each ticket dependent on the cards associated with the symbols shown thereon.

In a preferred embodiment, the aforesaid game of cards, according to whose rules the score is allotted, is the game of poker.

The invention will be now described in detail with reference to a preferred embodiment thereof shown, by way of illustration and not of limitation in the accompanying drawings, where:

BRIEF DESCRIPTION OF THE DRAWINGS

FIGS. 10 and 11 show schematically the inventive game as used in combination with a newspaper heading.

DESCRIPTION OF THE PREFERRED EMBODIMENTS

Figure 1:
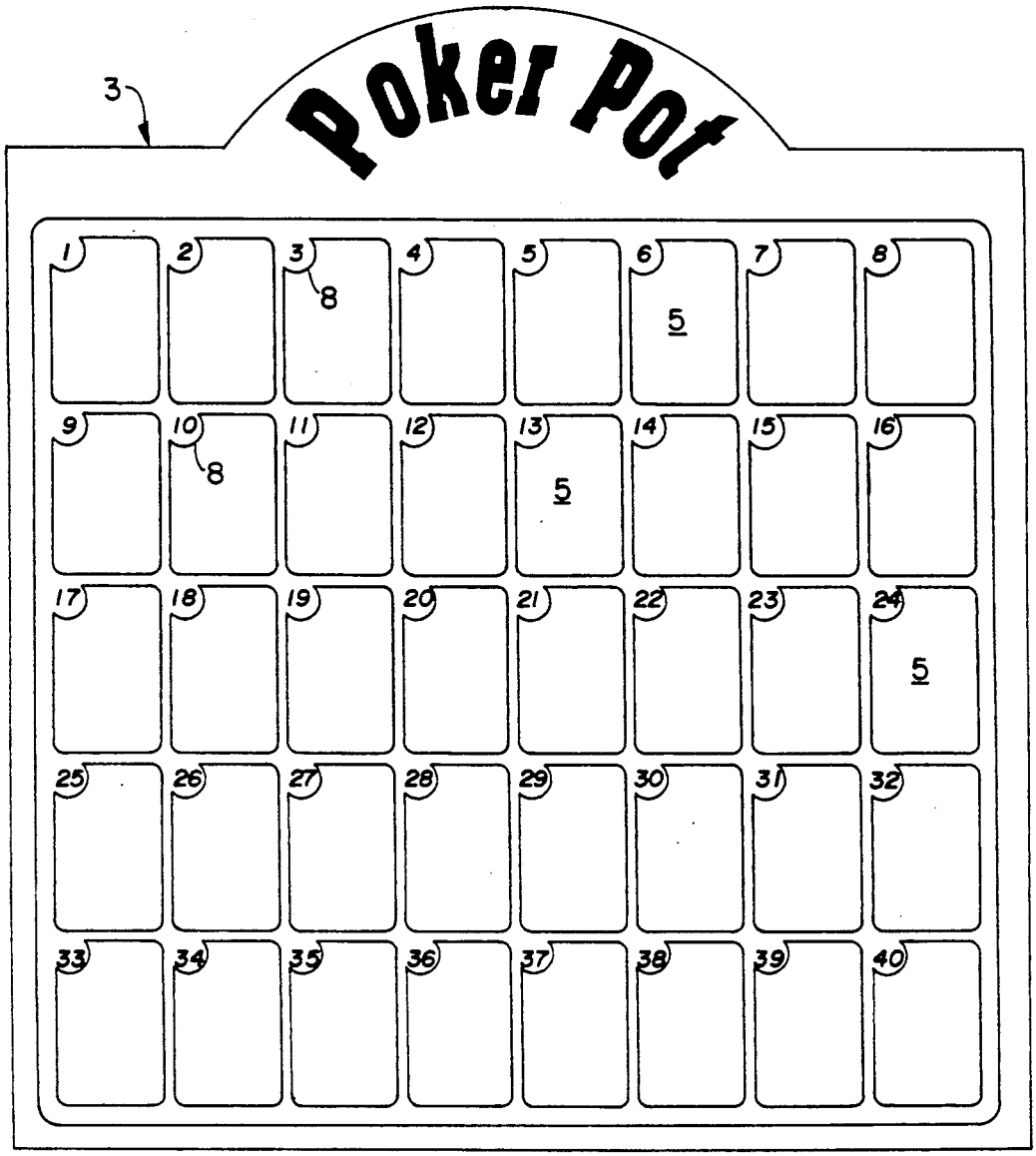
FIG. 1 is a front view of a display board used with the game of this invention.
Figure 2:
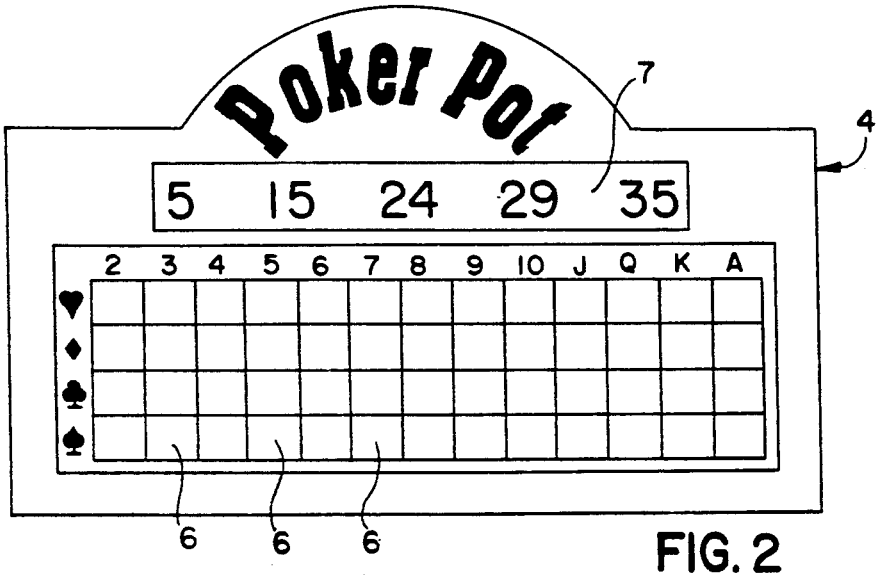
FIG. 2 shows a ticket for participation in this game.
Figure 3:
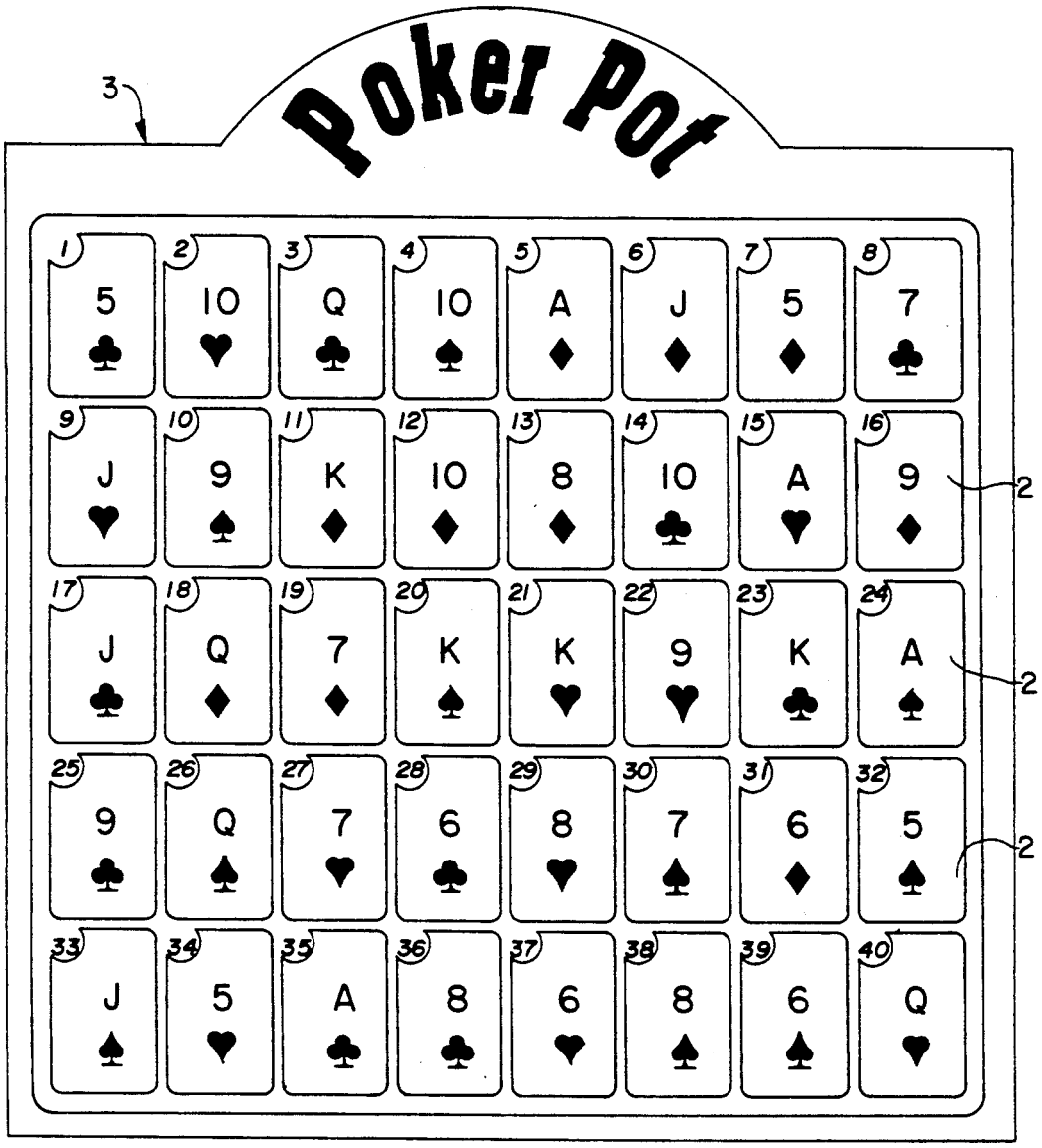
FIGS. 3 and 4 are views corresponding to FIGS. 1 and 2, respectively, with the game in progress.
Figure 4:
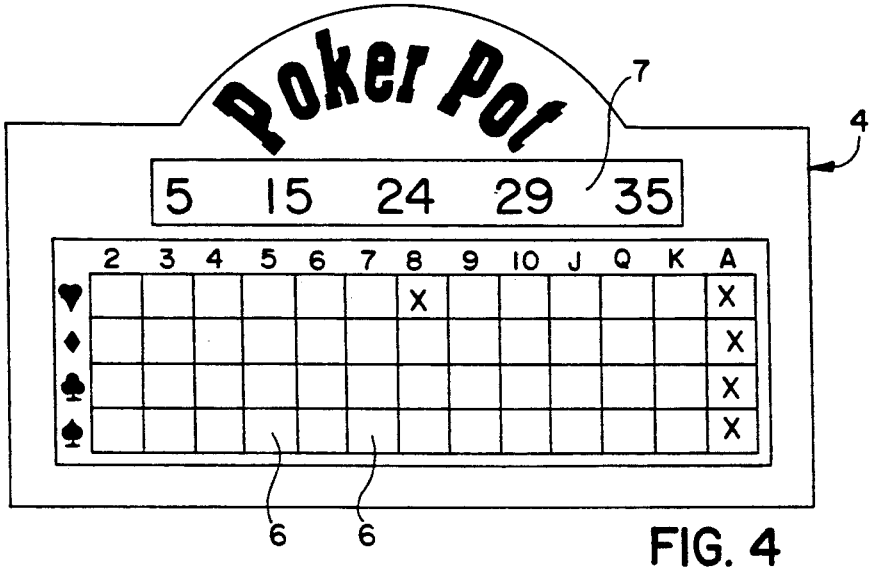

With specific reference to FIGS. 1–4, the game of this invention employs an ordinary pack or deck of cards, such as a pack of forty poker-playing cards, all indicated at 2, a display generally shown at 3, and a plurality of participation tickets, each shown generally at 4.

The display 3 is divided into a plurality of squares 5, one for each card 2 in the pack, and provided with a clear front wall bearing a growing numerical symbol from one to forty at each square.

Accordingly, by introducing each card 2 into a corresponding square 5 of the display 3, a random combination of the card with the numerical symbol shown on the square will be obtained, which is obviously quite unrelated to the card worth.

In quite a similar fashion, it is contemplated that the display 3 may be in the form of an electronic board adapted to display the various cards and to perform the random combination of the same with the corresponding squares.

Each ticket 4 comprises a grid of squares 6 in a corresponding number with the number of the cards in the pack and so grouped as to be subdivided according to the suit and worth of each card. This grouping is accomplished, in the example shown, by subdividing the squares 6 into a grid of four lines, each to correspond with a respective suit, and thirteen columns, each corresponding to one card worth. Thus, each card in the pack will be identified by its corresponding square through line and column.

In addition, the tickets 4 include an area 7 wherein five random selected numbers are printed which would be different from one another and selected from the numbers (one to forty in the example) shown on the squares 5, thereby correspondence will exist of the numbers shown in the area 7 with the numbers marking each square 6.

After shuffling the cards 2 which make up the pack, they are introduced one into each square 5 such that their worth and suit become temporarily associated with the numerical symbols on the display 3. The players will then cross-check with the five numbers shown in the area 7 of their own tickets by observing the card worth shown in the corresponding squares 5 of the display. These cards are identified on the ticket by marking, e.g. crossing, the corresponding squares 6. The score assigned to each ticket is the corresponding one with the game of poker, namely pair, two pairs, three of a kind, full house, flush, sequence, poker, and royal flush. The use of score rules which are typical of the best-known game of cards, poker, makes the pattern of participation in this novel game readily mastered, thereby encouraging new players.

It will be noticed that the particular configuration of the grid of squares 6 on the tickets 4 makes for easy score keeping. In fact, poker is scored on filling the column of squares with the same worth, flush when all the crosses are aligned on the same line, etc.

The next step in the game is the so-called 'calling out of scores'. In this step, the game conductor will 'call out' the various poker scores, from the highest to the lowest (royal flush, poker, . . . ) and the player whose ticket corresponds, by the numbering shown in the area 7, to the score called out shall declare it. Then, the conductor verifies the score declared by the player, and in the event that several players have declared the same score, which of them holds the highest worth, so as to select a single winner.

In a variation of this game, the jackpot would be divided into two shares. The first of these is allotted according to the above-described procedure; the second may be freely claimed by one or more players, except those players who have already declared their scores for the first share.

Each player applying for the second share shall pay an equal amount to that of the share itself, irrespective of the number of the players who are applying for it. This amount will add to the original value of the second share at stake. Therefore, the overall value of the second share will be raised as many times as are the players applying for it.

At this stage, should the second share be claimed by just one player, the latter may appropriate it without being bound to declare his score. If the share is claimed by several players, it shall be allotted to the one scoring highest. Lastly, should the second share remain unclaimed by any of the players, then it shall be added to the jackpot of the following game.

This first variation allows participation in the game of this invention at two levels of risk: the first level, which is typical of drawing games, is the one corresponding to allotment of the first jackpot share, whereas the second level, corresponding to the second share, is typical of wager games.

Figure 5:
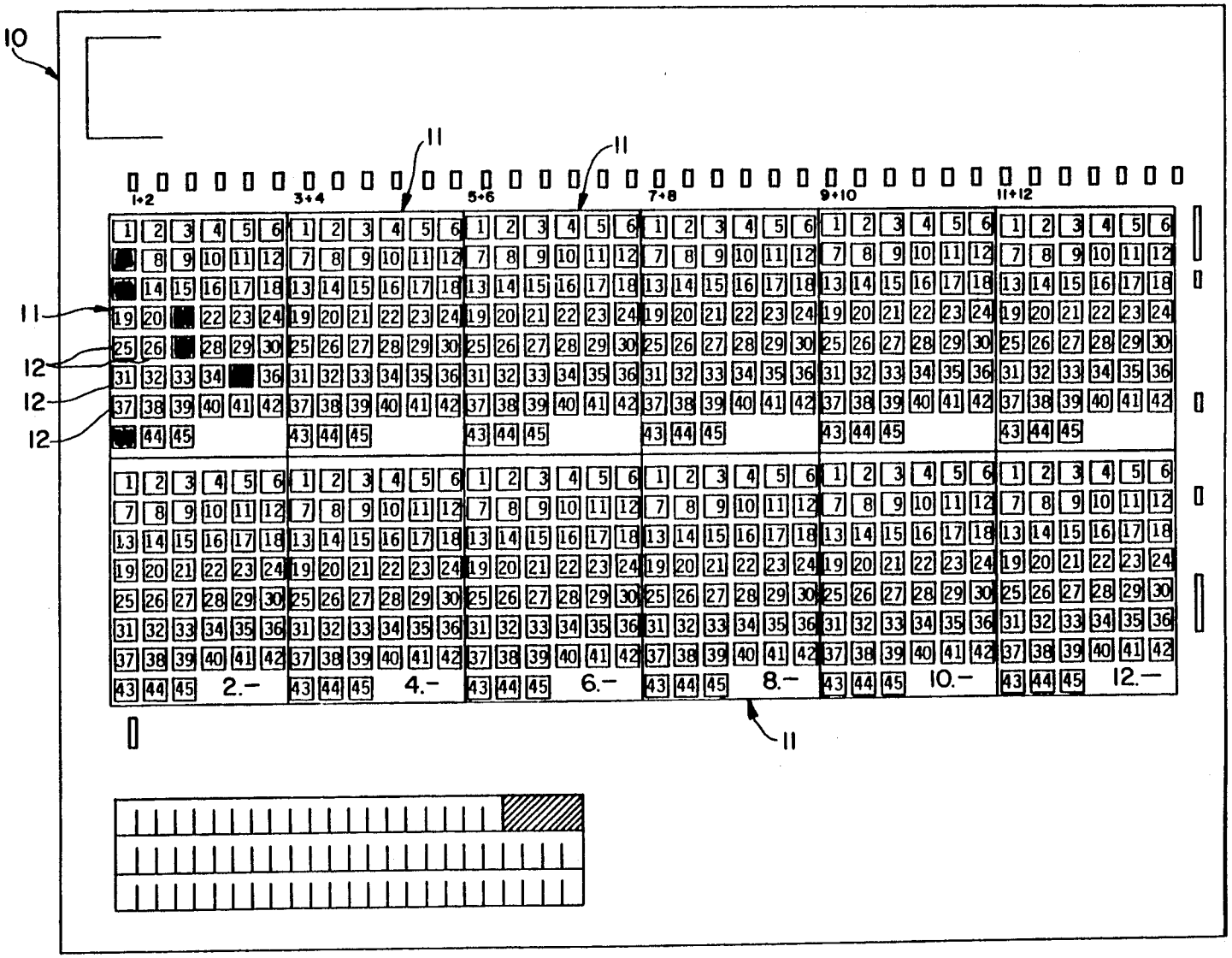
FIG. 5 shows schematically the inventive game as used in combination with a lottery.
Figure 6:
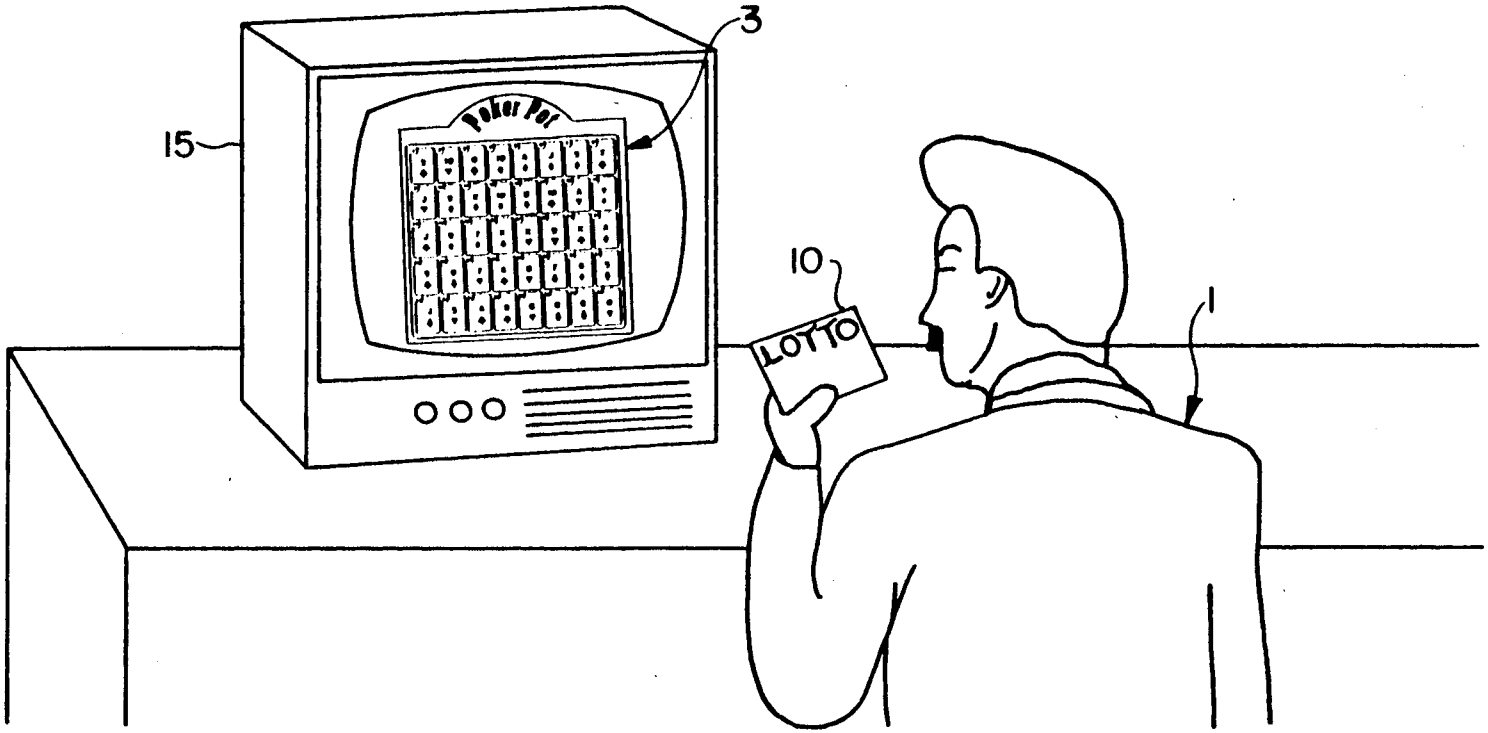
FIGS. 6 to 9 show schematically the inventive game as used in combination with a quiz program.

In a further variation, to be described with reference to FIGS. 5 and 6, the game is combined with a lottery, such as the LOTTO lottery well-known in many European countries.

Participation in this lottery provides for the use of a ticket 10 bearing a plurality of groups 11 of squares 12, each identified by a number growing from one to forty five.

To participate in the drawing, the player 1 is to blacken out six squares 12 from one or more groups 11, thereby locating six numbers (7, 13, 21, 27, 35 and 43 in this example). Irrespective of the score achieved in the drawing pertaining to the lottery, the player 1 may take part, with the first five numbers (7, 13, 21, 27 and 35), in the game of this invention in accord with the procedures outlined hereinabove. In the example, the temporary combining of the cards 2 in the pack with the numerical symbols on the squares would broadcast by a TV network, in the course of a program received on a TV set 15.

This variation enables losing tickets from the lottery drawing to be put back on stake, thus promoting the popularity of the lottery itself.

Another variation of this game, specially intended for publishing trade promotion, will be described with reference to FIGS. 10 and 11.

In this variation, the game elements include a ticket 20, e.g. in the same size as an ordinary credit card, for distribution to the public and to be valid throughout the promotion campaign period, and a daily newspaper, of which there are partly reproduced five pages, all indicated at 21.

The ticket 20 carries five different numbers in the one to forty or one to fifty two ranges, depending on the newspaper circulation. Shown on each page 21 is the symbol of a different playing card, along with the number which normally identifies the corresponding page. The player will participate in the game with the cards displayed on the newspaper pages the numbers whereof coincide with the five numbers shown on the corresponding ticket. In the example of interest, the player holding the ticket shown in FIG. 11 would participate in the game with the cards reproduced on pages 2, 17, 23, 27 and 33 to score an ace poker.

By sending his/her ticket 20 to the game organizer, any player who has achieved a predetermined score becomes entitled to participate in the periodic drawing of prizes from all the tickets entered. Thus, different scores may give rise to differentiated wins. Furthermore, any players who may have achieved the highest score can inform the game organizer of that result. The organizer will then allot an immediate prize to that player who has reported the highest overall score (royal flush to the ace of hearts).

In quite a similar manner, several cards may be reproduced on a given one page, in the limit to the point of reproducing all the cards on one page, obviously identifying them by different numbers.

This variation of the game has two major advantages in that it ensures one win and a single winner every day, thus making the handling of wins simple and unequivocal. In addition, the playing cards may be reproduced within advertising spaces, to improve their effectiveness, or contain advertising messages themselves.

Figure 9:
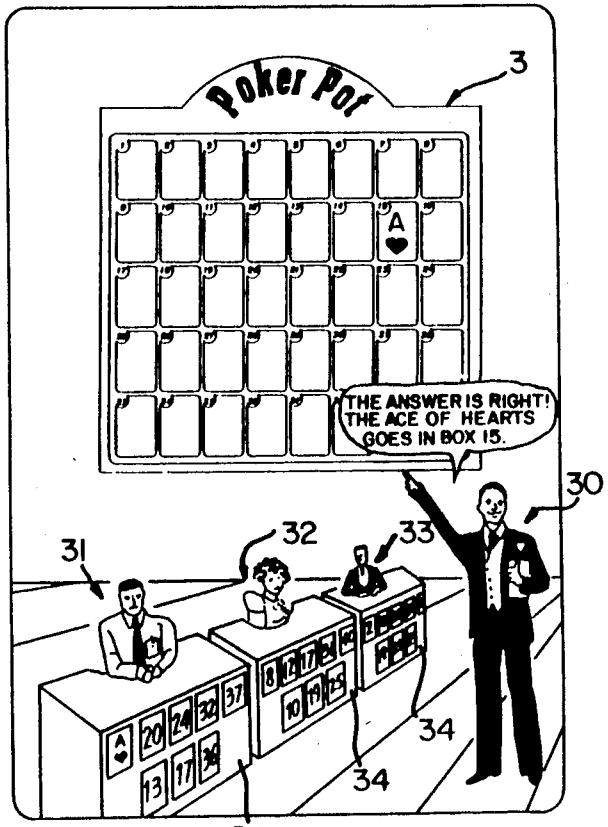
Figure 8:
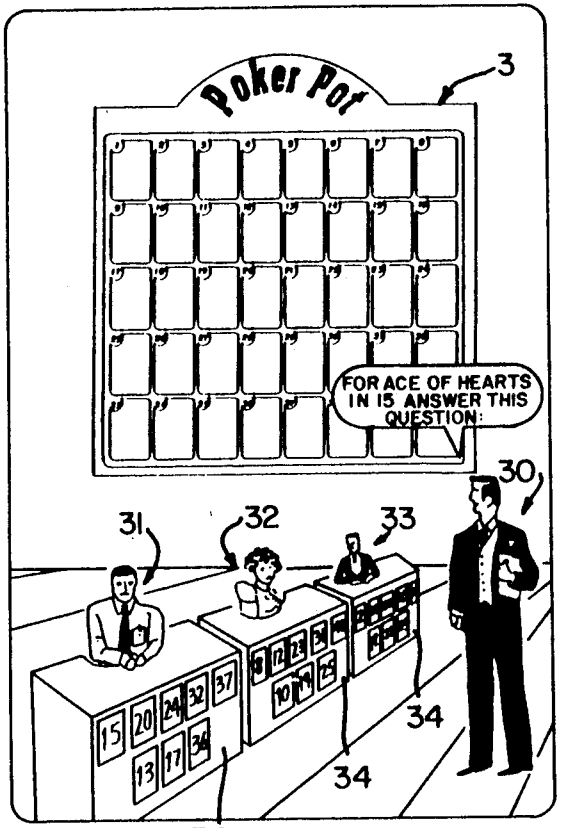
Figure 7:
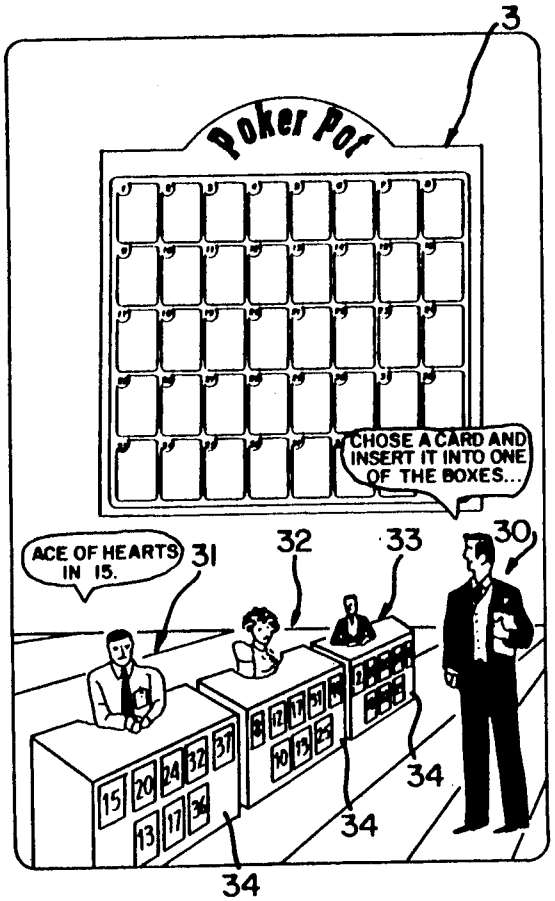

A fourth variation of the game according to this invention is represented with reference to the diagrams of FIGS. 7-9. The game includes two separate and simultaneous steps, the first of which (the one shown in the figures) takes place in a TV studio between a conductor 30 and two or more competitors 31, 32, 33, whereas the other step takes place at home and involves the player directly.

The first step follows the main rules of a typical quiz game, with additions as explained hereinafter.

During this step, each competitor is seated at a respective place 34 and the same is assigned a series of numbers (eight in the example shown) corresponding to as many squares of the display 3. The game conductor is to ask respective questions to each competitor in accordance with a predetermined order. Before answering its question, the competitor will be allowed to pick up one card from the forty cards in the deck and the number of the square 5 where it should be placed. He/she may either select one from the eight squares corresponding to the eight numbers allotted to his/her place 34, or select one from the squares of the other competitors and, therefore, interrupt their play. If the answer given is correct, the card of choice is placed in the requested square, or else returned to the deck. After all the questions have been asked, squares left empty are filled by drawing the remaining cards by lots. The first step of the game is won by that competitor who scores highest with five cards selected from the eight cards which correspond to the number allotted to his/her place. The second and contextual step of the game sees the TV watchers involved who hold participation tickets 4 identical with those represented in relation to the first game example. They are to follow the fate of each individual question and of the various game strategies selected by the competitors. The scores and criteria for winning are the same as described in relation to the first example.

Among the many advantages of this invention is the fact that it is a simple yet spectacular game, and ensures considerable attraction, especially at the card drawing stage, and a certain trepidation upon "calling out the points".

In addition, the game mechanics will always pick up a single winner, with no chance for errors, makes for active participation with greater risk, thus attracting a variety of players, and the short duration of each contest enables the players to try again their luck several times within a comparatively short time.

I claim:

1. A method of playing a card chance game comprising the steps of, providing a deck of playing cards having four suits, each suit having cards of the same numbers, pictures, or combinations thereof, temporarily associating each card in the deck with a symbol selected irrespectively of the suit, number, picture, or combination thereof of said card, providing a plurality of tickets, each bearing a discrete series of said symbols corresponding to said cards, and allotting, according to the rules of a known game of cards, a score for each ticket dependent on the cards associated with the symbols shown thereon.

2. The method of playing a card chance game according to claim 1, wherein the known game of cards according to whose rules said score is allotted is poker.

3. The method of playing a card chance game according to claim 2, wherein the discrete series on each ticket comprises five symbols.

4. The method of playing a card chance game according to claim 2, wherein a jackpot is defined which is divided into two shares, the first of which is allotted according to a score to be declared by one or more players in relation to the score observed on the corresponding tickets, and the second of which is susceptible to request by one or more players who will rise said share by as many times as are the players submitting said request, said second share being allotted to the player who applied for it if that request has been submitted by a single player or to the highest-scoring player if said share has been requested by several players.

5. The method of playing a card chance game according to claim 1, wherein said symbols are numerals increasing with the sequential order of association between symbols and cards.

6. The method of playing a card chance game according to claim 1, wherein the temporary association between symbols and cards takes place by means of a display having a plurality of squares, one for each card, each of which squares is identified by a different symbol, said squares being associable indifferently with any of the cards in the deck.

7. A card chance game structure for use with a deck of playing cards having at least one suit, each suit having cards of the same numbers, pictures, or combinations thereof including:

a display divided into a plurality of squares, each adapted to show one playing card, said squares being each identified by a different symbol; and a plurality of participation tickets each bearing a discrete series of said symbols identifying corresponding squares; wherein said tickets comprise a grid of squares arranged in matrix form and corresponding in number to the squares of said display, the rows or columns of squares in the matrix identifying the suit and the other the number, picture, or combination thereof of said cards.

8. A card chance game structure according to claim 7, wherein the symbols which identify said squares are numerals and the squares are numbered sequentially.

9. A card chance game structure according to claim 7, wherein the series of symbols comprise five symbols on each ticket.

10. A card chance game structure according to claim 7, wherein said tickets are tickets for participation in a lottery.

* * * * *